US005653472A

United States Patent [19]

Huddleston et al.

[11] Patent Number: 5,653,472

[45] Date of Patent: Aug. 5, 1997

[54] FORM HAVING DETACHABLE WRISTBAND AND LABELS

[75] Inventors: Joey V. Huddleston, Winter Springs, Fla.; Richard Meara, Spring Valley; David F. Laurash, Bellbrook, both of Ohio

[73] Assignee: The Standard Register Company, Dayton, Ohio

[21] Appl. No.: 506,802

[22] Filed: Jul. 25, 1995

[51] Int. Cl.[6] ..... B42D 15/00

[52] U.S. Cl. ..... 283/75; 283/900; 40/633

[58] Field of Search ..... 40/633; 283/74, 283/75, 81, 900; 428/40–43

[56] References Cited

U.S. PATENT DOCUMENTS

| | | | |
|---|---|---|---|
| 2,641,074 | 6/1953 | Richmond | 40/633 |
| 3,153,869 | 10/1964 | Twentier . | |
| 3,197,899 | 8/1965 | Twentier . | |
| 3,279,107 | 10/1966 | Baumgartner . | |
| 3,848,112 | 11/1974 | Weichselbaum et al. . | |
| 3,983,604 | 10/1976 | Phillips . | |
| 4,078,324 | 3/1978 | Wiebe . | |
| 4,122,947 | 10/1978 | Falla . | |
| 4,221,063 | 9/1980 | Charles et al. . | |
| 4,314,415 | 2/1982 | De Woskin . | |
| 4,318,234 | 3/1982 | Charles et al. . | |
| 4,612,718 | 9/1986 | Golub et al. . | |
| 4,682,431 | 7/1987 | Kowalchuk . | |
| 4,914,843 | 4/1990 | DeWoskin . | |
| 4,916,841 | 4/1990 | Dawson . | |
| 4,951,971 | 8/1990 | Whited . | |
| 4,991,337 | 2/1991 | Solon . | |
| 5,026,084 | 6/1991 | Pasfield . | |
| 5,048,870 | 9/1991 | Mangini et al. | 283/900 X |
| 5,364,133 | 11/1994 | Hofer et al. . | |

*Primary Examiner*—Willmon Fridie, Jr.

*Attorney, Agent, or Firm*—Killworth, Gottman, Hagan & Schaeff LLP

[57] ABSTRACT

A form having detachable labels and a wristband is provided. The form includes a face ply adhered to a liner ply by a pressure sensitive adhesive. The face ply includes a first portion and a second portion, where the first portion is die cut to form a wristband and the second portion is die cut to form a series of detachable labels. The form may be printed in a single pass through a printer to provide the wristband and labels with correlating printed indicia.

19 Claims, 8 Drawing Sheets

FORM HAVING DETACHABLE WRISTBAND AND LABELS

BACKGROUND OF THE INVENTION

The present invention relates to a printable form, and more particularly, to a form having a wristband accompanied by a plurality of detachable labels which may be printed with information in a single pass through a printer.

It is a common practice in hospitals to identify patients with a bracelet or band containing the patient's name or other identification information. The band is generally secured around the wrist of a patient so that hospital personnel can properly identify the patient during his stay. However, while this has been an effective method of identifying patients, many hospitals have had problems correlating patient information on specimens, drug prescriptions, physician's orders, etc. Clerical errors in the handling of such routine matters can result in the dispensing of the wrong medicine or treatment to a patient.

Several attempts have been made to improve the correlation of patient information to various hospital forms. For example, Falla, U.S. Pat. No. 4,122,947 teach a prepackaged patient identification kit which includes a wristband, a specimen container, and a label for attachment to a patient's record, all of which have been provided with identical patient information. Weichselbaum et el, U.S. Pat. No. 3,848,112, teach a patient identification system in which an identification bracelet secured to a patient is used to dispense a series of tags which are magnetically coded with patient information. However, this method requires the use of a tag reader as well as circuitry which is capable of decoding the information on the tag. Accordingly, while such methods may provide an effective means of identifying a patient for various purposes, such methods are complex and difficult to implement.

Accordingly, there is still a need in the art for an identification system which includes a wristband as well as an accompanying series of labels or tags which can be efficiently provided with correlating identification information, and which can be easily dispensed and used for a variety of applications.

SUMMARY OF THE INVENTION

The present invention meets those needs by providing a single form which includes a wristband as well as an accompanying series of detachable labels. The form may be printed in a single pass through a printer which provides unique patient identification information on both the wristband and on each of the labels. The wristband may be peeled away from the form and attached to a patient's wrist, and the labels removed as needed and applied to hospital forms, containers of medicine, etc. The form may be printed using a variety of printers including mechanical impact, direct thermal, thermal transfer, ink jet, and laser printers.

In accordance with one embodiment of the invention, a form having detachable labels and a wristband is provided comprising a printable face ply having first and second major surfaces and having a pressure sensitive adhesive on at least a portion of one surface thereof. The first surface of the face ply preferably includes printed indicia thereon and may be printed in a single pass through a printer with both variable and nonvariable information. The face ply includes first and second adjacent portions, where the first portion of the face ply is die cut to form a detachable wristband having first and second ends and first and second sides. The second portion of the face ply is die cut to form a series of detachable labels.

The form also includes a liner ply having first and second major surfaces. The liner ply includes a release coating on at least a portion of one surface and is adhered to the pressure sensitive adhesive on the first or second surface of the face ply. Preferably, the liner ply is coextensive with the face ply.

In a preferred embodiment of the invention, the first and second portions of the face ply are separated and may comprise different materials. For example, the first portion of the face ply may comprise a polymer such as polyester and the second portion of the face ply may comprise paper. In an alternative embodiment, the entire face ply may comprise paper or a polymer.

In another embodiment of the invention, the liner ply is also divided into first and second portions, where the first portion of the liner ply adheres to the first portion of the face ply, and the second portion of the liner ply adheres to the second portion of the face ply. In this embodiment, the second portion of the liner ply preferably partially overlaps the first portion of the liner ply, i.e., it extends beyond the second portion of the face ply.

In a preferred embodiment of the invention, the face ply is adhered to the liner ply by a pressure sensitive adhesive included on at least a portion of its second surface. In one embodiment, the pressure sensitive adhesive is included on the first portion of the face ply around the periphery of the wristband and on the first and second ends of the wristband. The pressure sensitive adhesive is also included on the second portion of the face ply in the area containing the series of labels.

In another embodiment of the invention, the wristband on the first portion of the face ply is doubled in width so as to be adapted to be folded in half along its longitudinal axis when removed from the form. In this embodiment, the pressure sensitive adhesive may be included on the entire second surface of the face ply. Alternatively, the pressure sensitive adhesive may be included on the first portion of the face ply around the periphery of the wristband, on the first and second ends of the wristband, along the edges of the first and second sides of the wristband, and on the the entire second portion of the face ply.

In another alternative embodiment, the pressure sensitive adhesive is included on the first portion of the face ply around the periphery of the wristband, on the first and second ends of the wristband, and on the entire second portion of the face ply.

The form of the present invention is preferably produced from a continuous web to facilitate printing and handling by automated equipment. The continuous web of forms is preferably defined by lines of weakness and may be folded zig-zag into a stack.

In practice, the plies of the form of the present invention are preferably assembled and then the face ply is printed in a single pass through a printer with the desired variable and nonvariable information. The wristband may then be detached from the form by peeling it from the liner ply and wrapping the band around the wrist of a patient. The wristband is then secured to the patient by means of the pressure sensitive adhesive on the wristband. The labels which remain on the form may be removed as needed and adhered to hospital forms, medicine containers, patient specimens, etc.

Accordingly, it is a feature of the present invention to provide a form having detachable labels and a wristband which may be easily provided with information by printing in a single pass through a printer. This, and other features and advantages of the present invention will become apparent from the following detailed description, the accompanying drawings, and the appended claims.

DETAILED DESCRIPTION OF THE PREFERRED EMBODIMENT

Figure 1:
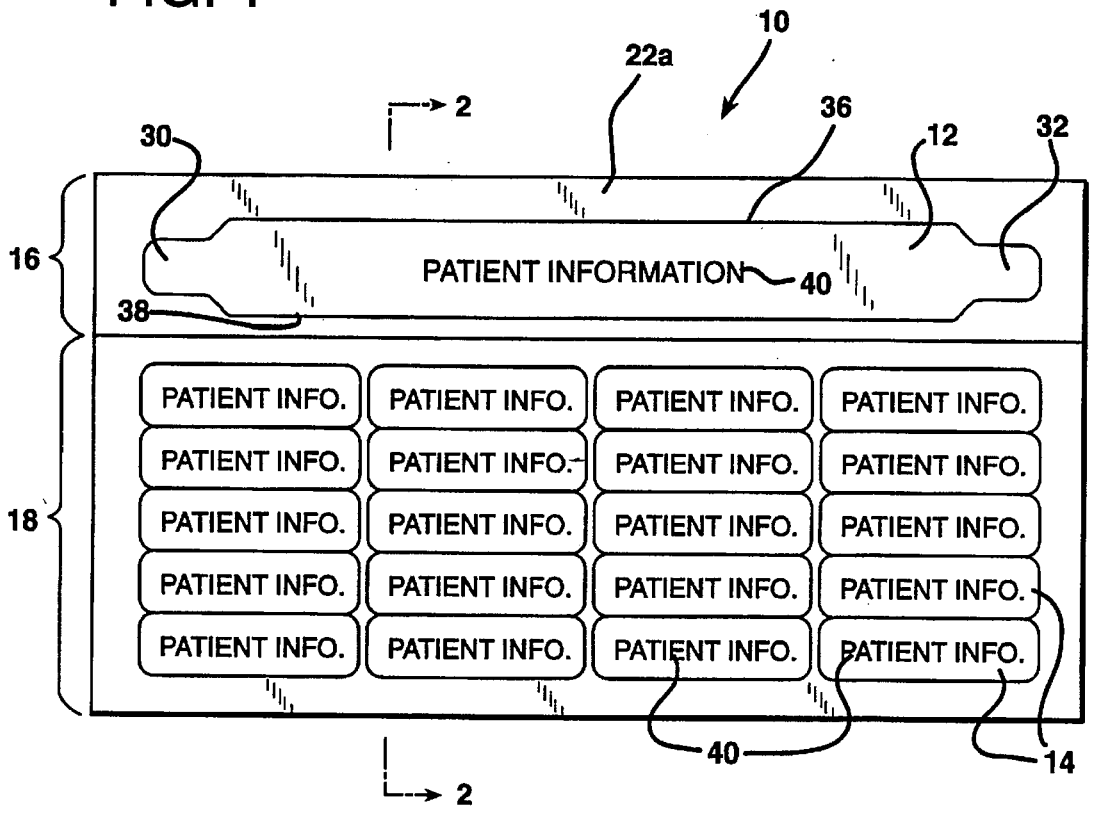
FIG. 1 is a top view of the form of the present invention.
Figure 2:
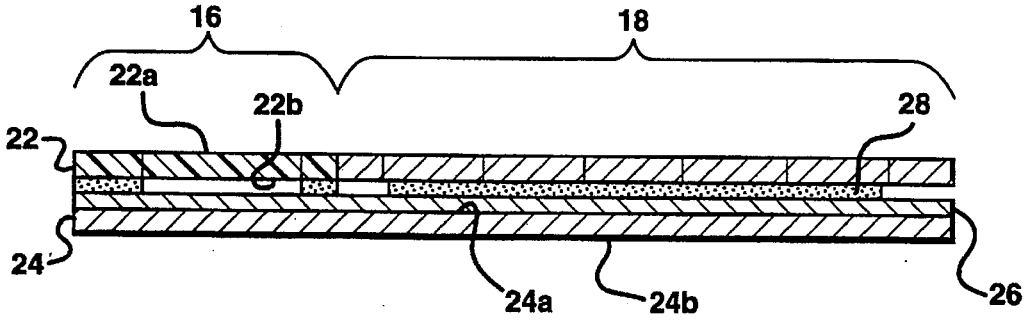
FIG. 2 is a cross-sectional side view of the form taken along line 2—2 FIG. 1.

Referring now to FIGS. 1 and 2, the form 10 of the present invention is shown which includes a wristband 12 having first and second ends 30, 32 and first and second sides 36, 38. The form also includes a series of detachable labels 14. As shown in FIG. 1, the form is separated into a first portion 16 which contains the wristband and a second portion 18 which contains the labels. Also as shown in FIG. 1, the first and second portions of the form have been printed with correlating indicia 40. By correlating indicia, we mean that indicia printed on the first portion corresponds to the indicia printed on the second portion. For example, the first and second portions may be printed with varied patient information, all of which relates to the same patient.

As shown in FIG. 2, the form 10 comprises a face ply 22 having a first surface 22*a* and a second surface 22*b* and a liner ply 24 having a first surface 24*a* and a second surface 24*b*. In this embodiment, the face ply in the first portion 16 is comprised of a different material than the face ply in the second portion 18. In portion 16, the face ply preferably comprises 0.002 inch thick white polyester film, while the face ply in portion 18 preferably comprises paper.

As shown in FIG. 2, the face ply is adhered to the liner ply by a pressure sensitive adhesive 28 included on a portion of the second surface 22*b* of the face ply. The liner ply 24 includes a release coating 26 on one surface so as to allow the face ply to be readily peeled away from the liner ply.

Figure 3:
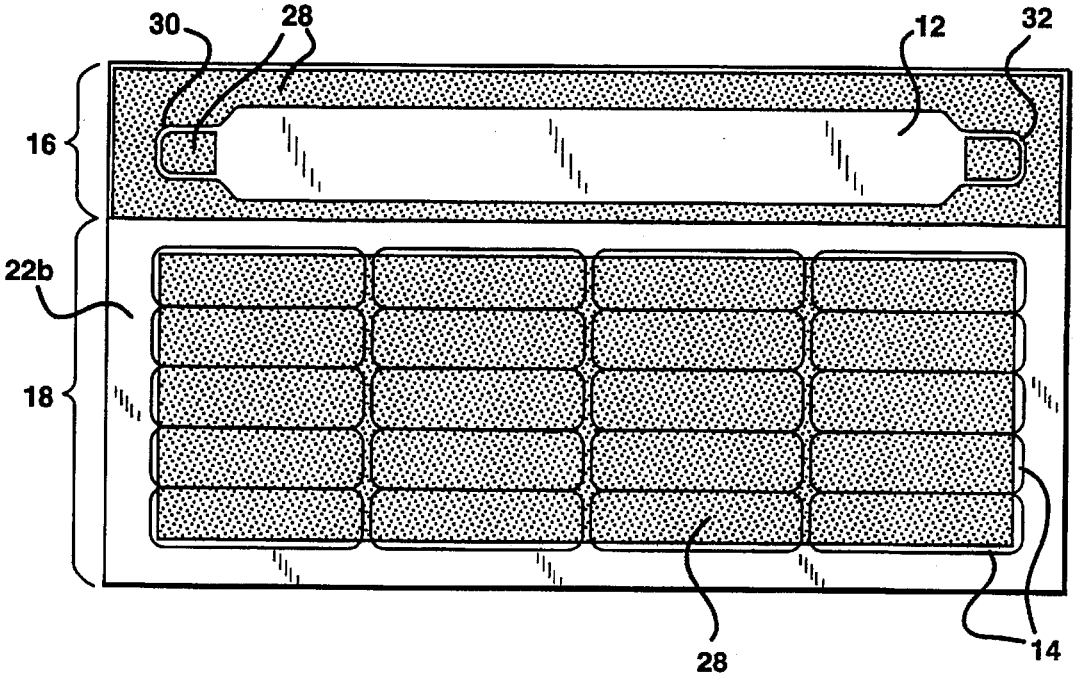
FIG. 3 is a bottom view of the form of FIG. 1.

FIG. 3 illustrates the portions of the second surface 22*b* of the face ply which include pressure sensitive adhesive 28. As shown in this embodiment, the pressure sensitive adhesive is included in first portion 16 around the periphery of wristband 12, and on the first and second ends 30, 32 of the wristband. In second portion 18, the pressure sensitive adhesive is included in the area containing the detachable labels 14. The pressure sensitive adhesive may be full coated or pattern coated as desired. For example, the pressure sensitive adhesive may be pattern coated on the form in a striped pattern.

Figure 4:
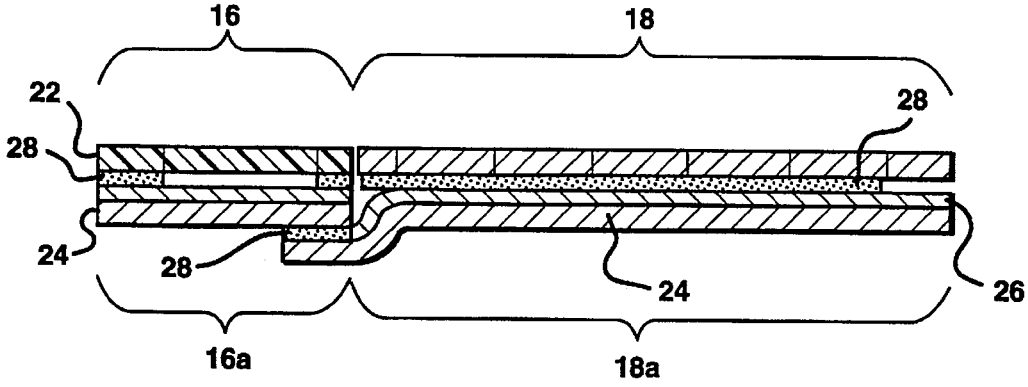
FIG. 4 is a cross-sectional side view of another embodiment of the invention.

FIG. 4 illustrates an alternative embodiment of the invention in which the liner ply 24 comprises first and second portions 16*a* and 18*a*. As shown, the first portion 16*a* of the liner ply adheres to the first portion 16 of the face ply, and second portion 18*a* of the liner ply adheres to second portion 18 of the face ply. As shown, the second portion of the liner ply preferably overlaps the first portion. In this embodiment, the face ply and liner ply are adhered together with adhesive in the area where their edges overlap.

Figure 5:
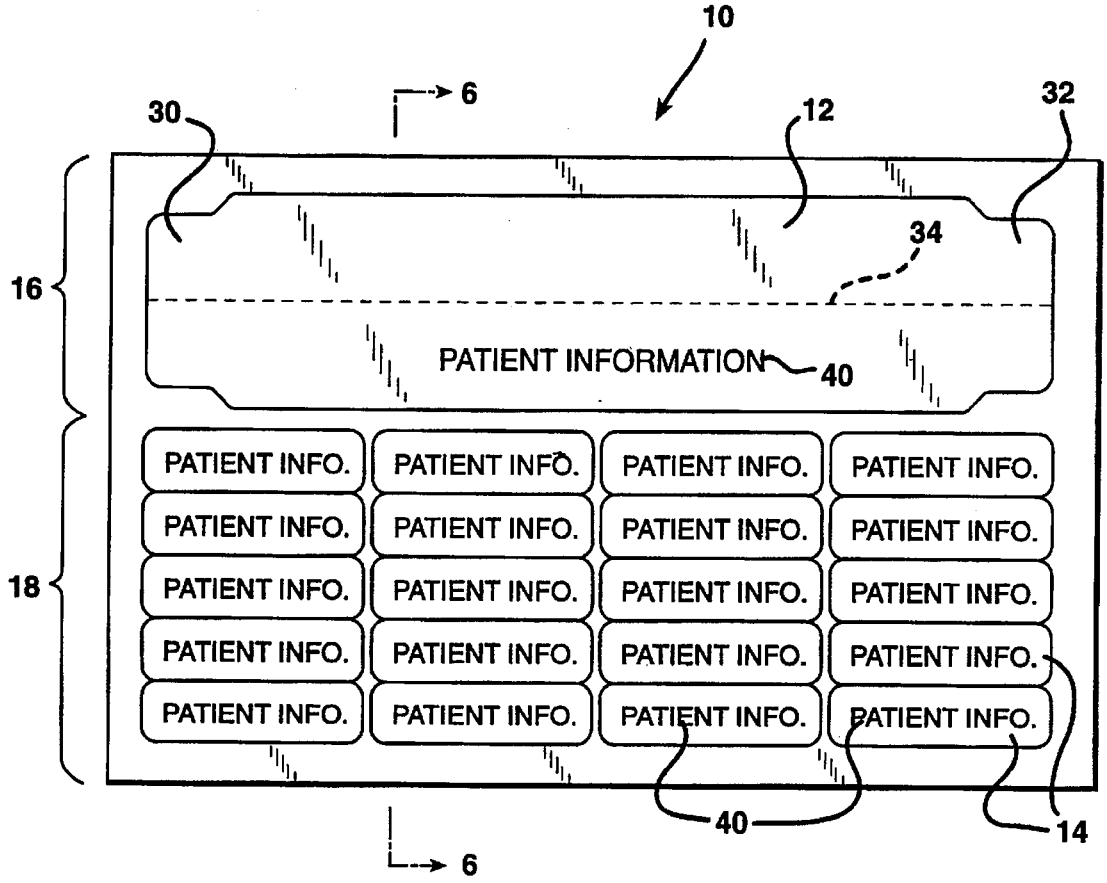
FIG. 5 is a top view of another embodiment of the invention.

FIG. 5 illustrates another embodiment of the invention in which wristband 12 is doubled in width so as to be adapted to be folded in half along its longitudinal axis when removed from the form as will be explained in greater detail below. As shown, the wristband includes a fold line 34.

Figure 6:
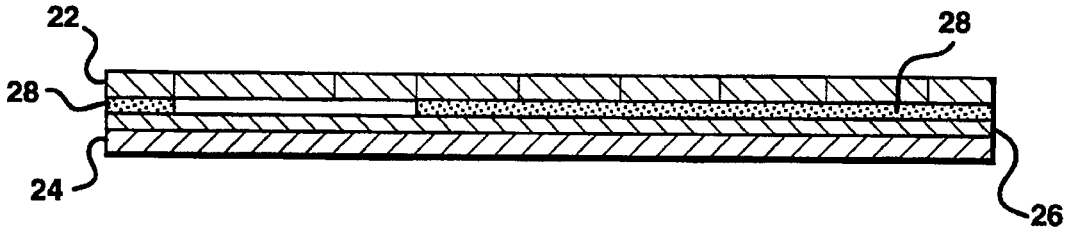
FIG. 6 is a cross-sectional side view of the form taken along lines 6—6 in FIG. 5.
Figure 7:
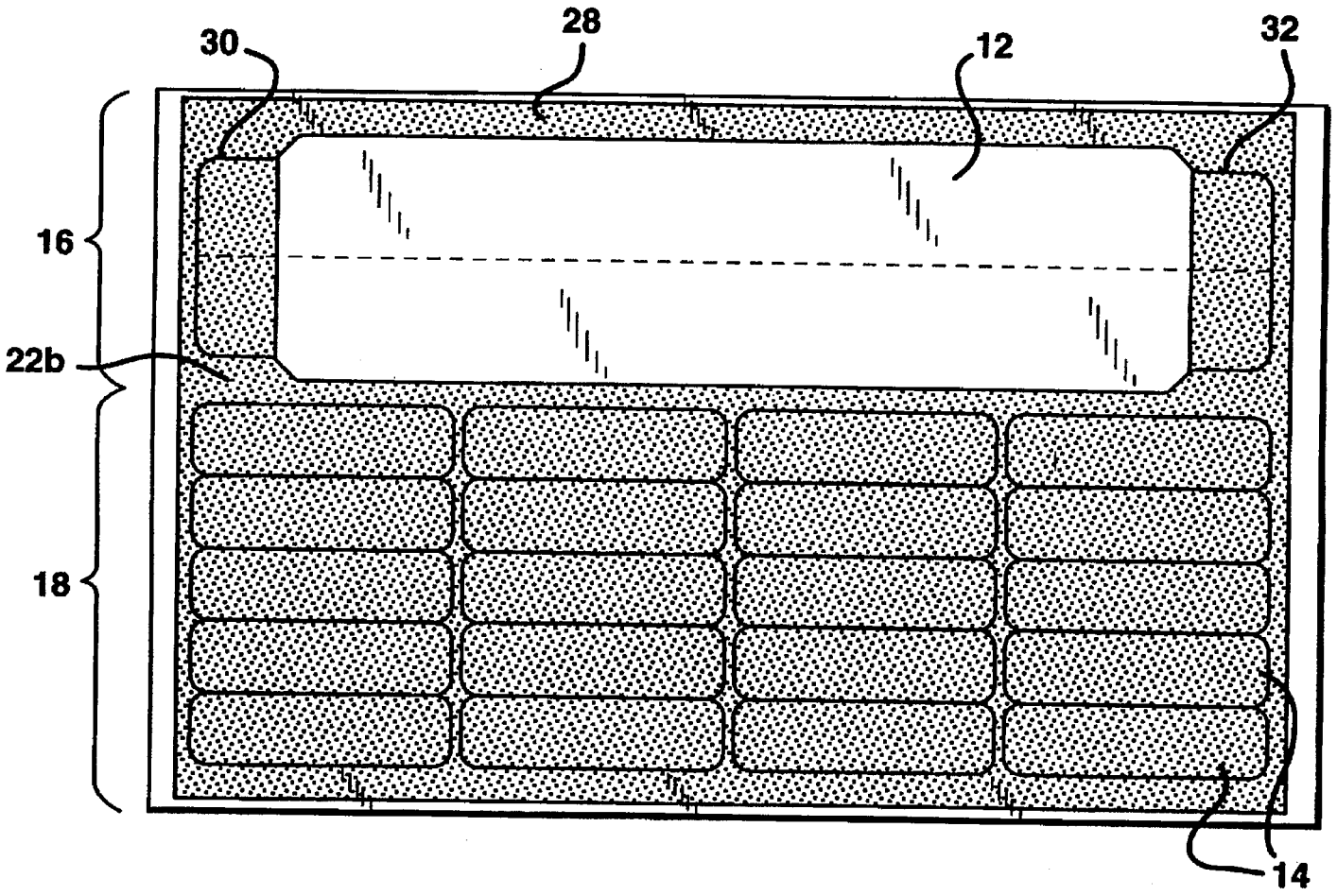
FIG. 7 is a bottom view of the embodiment shown in FIG. 5.

In the embodiment shown in FIGS. 5 and 6, the face ply is not die cut between first portion 16 and second portion 18 and is comprised of only one material such as paper. The second surface 22*b* of the face ply is shown in FIG. 7 and includes a pressure sensitive adhesive on the entire second portion 18. The first portion 16 includes the pressure sensitive adhesive around the periphery of the wristband and on the first and second ends 30, 32.

Figure 8:
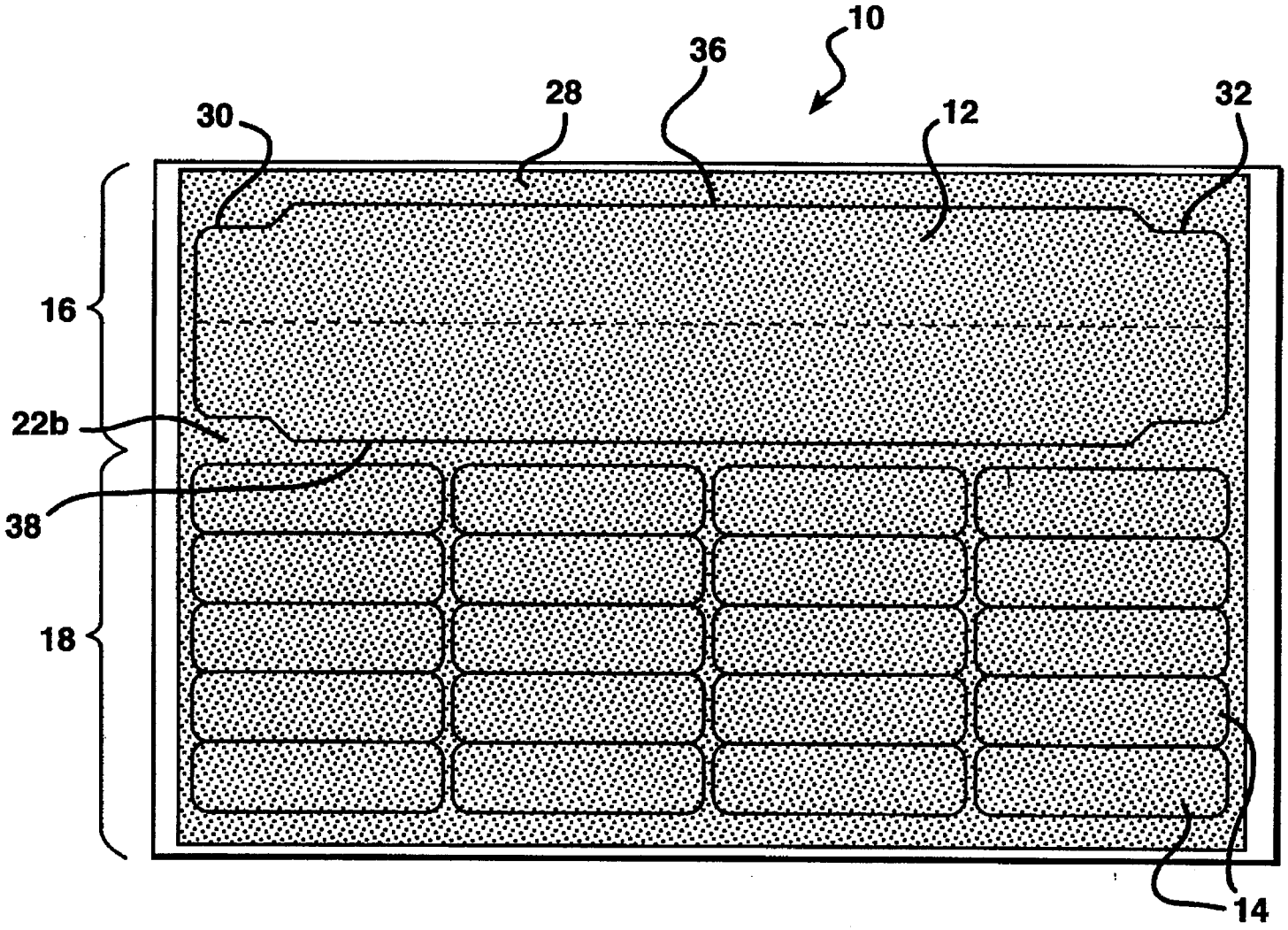
FIG. 8 is a bottom view of an alternative embodiment of the invention.

In another embodiment of the invention shown in FIG. 8, the entire second surface 22b of face ply 22 includes a pressure sensitive adhesive 28. In this embodiment, the sides 36, 38 can be folded together when the wristband is removed from the form such that the pressure sensitive adhesive adheres to itself.

Figure 9:
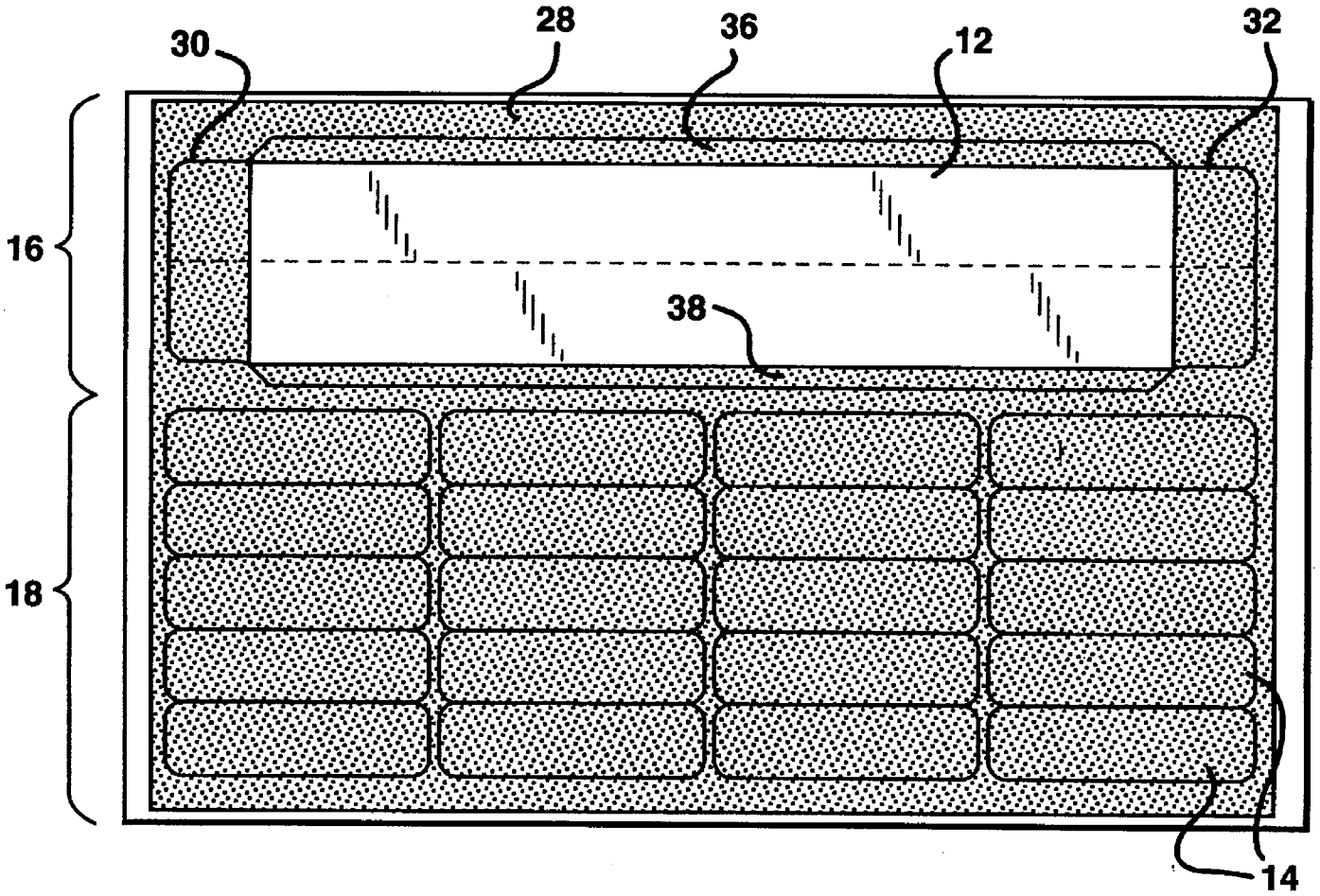
FIG. 9 is a bottom view of another alternative embodiment of the invention.

FIG. 9 illustrates yet another embodiment of the invention in which the pressure sensitive adhesive is included around the periphery of the wristband, on the first and second ends of the wristband, and along the edges of the first and second sides 36, 38.

In addition to the embodiments shown, it should be appreciated that the pressure sensitive adhesive may be included in a number of other arrangements on the second surface of the face ply as desired. It should also be appreciated that the arrangement of the labels and wristband on the form may be varied. For example, the form may contain labels of different sizes, it may contain more than one wristband, or it may contain a greater or fewer number of labels. It is also possible that the wristband may be located on the center of the form and the labels positioned above and below it.

Figure 10:
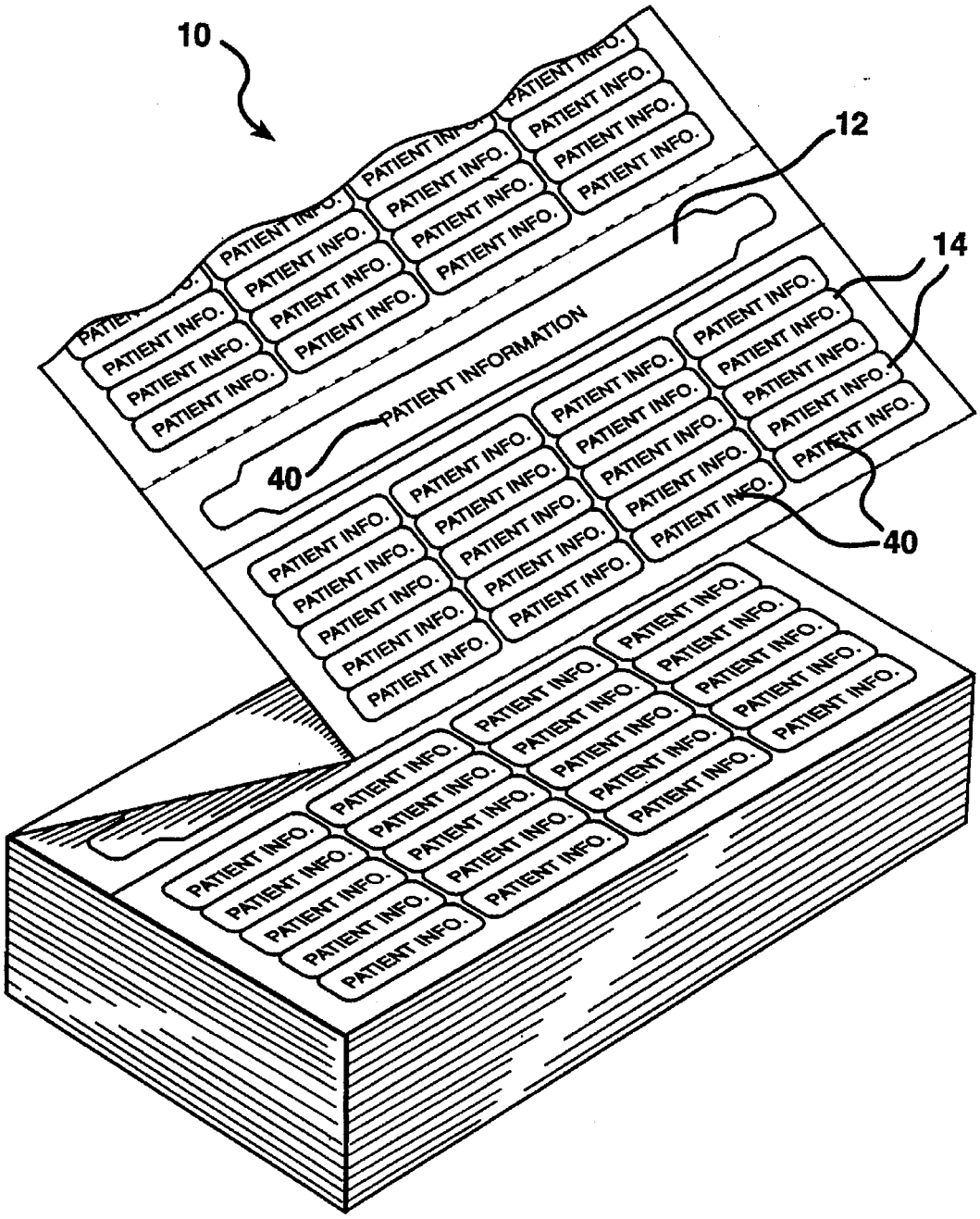
FIG. 10 is a perspective view of a continuous web of forms constructed in accordance with the present invention.

The form of the present invention is preferably produced as a continuous web product as shown in FIG. 10 which may be fed through a printer in a single pass to add indicia 40 simultaneously on the wristband and on each of the labels. The printed indicia may include nonvariable information (i.e., information which does not change from label to label) such as the hospital name, and variable information (i.e., information which is unique to an individual and which changes from label to label) such as the patient's name and identification number. The face ply may be printed using a number of different automated printing devices including impact printers, ion deposition printers, ink jet printers, laser printers, direct thermal printers, and thermal transfer printers. If direct thermal printing is used, an imaging coating must be provided on the face ply of the form.

Figure 11:
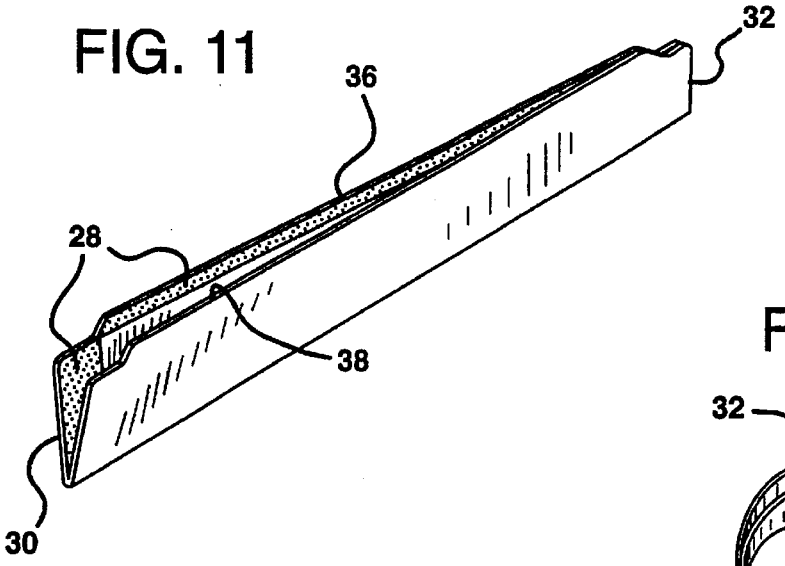
FIG. 11 is a perspective view illustrating the wristband after removal from the form.
Figure 11A:
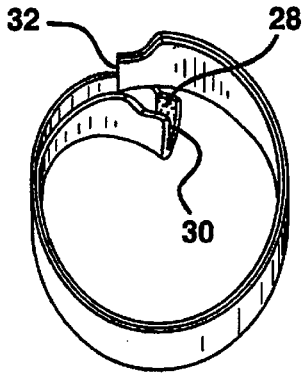
FIG. 11*a* is a perspective view illustrating how to secure the wristband.
Figure 12:
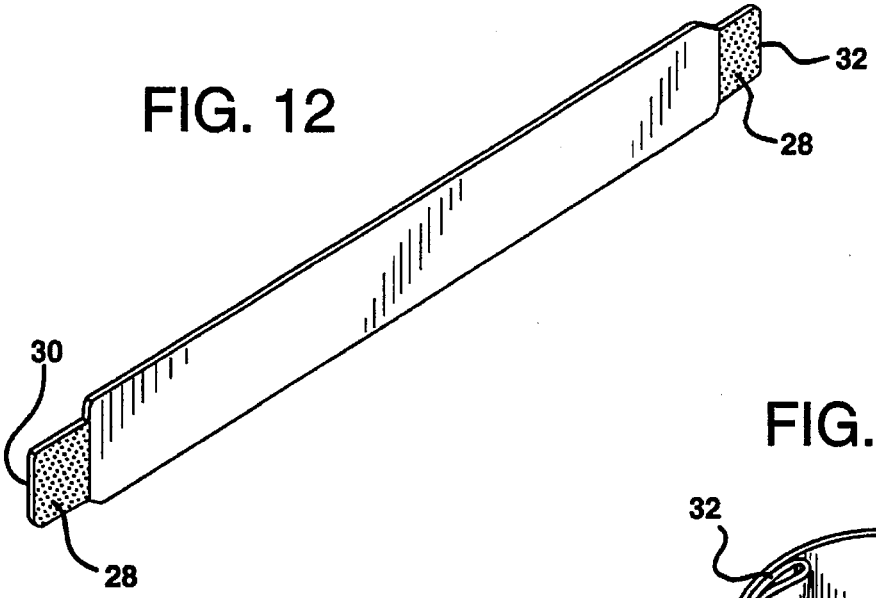
FIG. 12 is respective view illustrating another embodiment of the wristband after removal from the form.

In use, the wristband is peeled away from the liner ply and secured around the patient's wrist by the pressure sensitive adhesive on the ends of the wristband. FIGS. 11–12 illustrate how to secure two different embodiments of the wristband. As shown in FIGS. 11 and 11*a*, the wristband is folded in half and adhered together by the pressure sensitive adhesive 28 along the side edges 36, 38. The wristband is then wrapped around a wrist and the folded end 32 is tucked into the other end 30 and adhered by the adhesive.

Figure 12A:
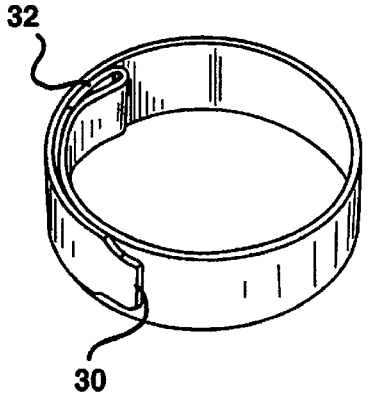
FIG. 12*a* is a perspective view illustrating how to secure the wristband shown in FIG. 12.

FIGS. 12 and 12*a* illustrates a single width wristband in which one end 32 of the wristband may be folded on itself while the other end is wrapped around the band in an overlapping position and is secured to the band by the pressure sensitive adhesive.

The form is attached to the patient's chart and accompanies the patient. The labels on the form may be removed as needed and adhered to containers of medicine, doctor's orders, patient specimens, or other forms by means of the pressure sensitive adhesive on the second surface of the face ply.

The form of the present invention may also find use in other applications. For example, the wristband and labels could be used for identification of plants in a nursery, or in a manufacturing plant where the wristband and labels could be used for identification of equipment or parts.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A form having detachable labels and a wristband comprising:

a printable face ply having first and second major surfaces and having a pressure sensitive adhesive on at least a portion of one surface thereof, said face ply including first and second adjacent portions, where said first portion of said face ply is die cut to form a detachable wristband having first and second ends and first and second sides, where said second portion of said face ply is die cut to form a series of detachable labels; and a liner ply having first and second major surfaces, said liner ply including a release coating on at least a portion of one surface thereof and being adhered to said pressure sensitive adhesive on said first or second surface of said face ply.

2. The form of claim 1 wherein said first and second portions of said face ply are separated by a die cut extending through said face ply.

3. The form of claim 2 wherein said first portion of said face ply comprises a polymer and said second portion of said face ply comprises paper.

4. The form of claim 1 wherein said face ply comprises paper.

5. The form of claim 1 wherein said face ply comprises polyester.

6. The form of claim 1 wherein said first surface of said face ply includes printed indicia thereon.

7. The form of claim 1 wherein said liner ply is coextensive with said face ply.

8. The form of claim 2 wherein said liner ply comprises first and second portions, where said first portion of said liner ply adheres to said first portion of said face ply and said second portion of said liner ply adheres to said second portion of said face ply.

9. The form of claim 8 wherein said second portion of said liner ply extends beyond said second portion of said face ply.

10. The form of claim 1 wherein said second surface of said first portion of said face ply includes said pressure sensitive adhesive around the periphery of said wristband and on said first and second ends of said wristband.

11. The form of claim 1 wherein said second surface of said second portion of said face ply includes a pressure sensitive adhesive in the area containing said series of labels.

12. The form of claim 1 wherein said wristband on said first portion of said face ply is adapted to be folded in half along its longitudinal axis.

13. The form of claim 12 wherein said second surface of said face ply includes a pressure sensitive adhesive.

14. The form of claim 12 wherein said second surface of said first portion of said face ply includes said pressure sensitive adhesive around the periphery of said wristband, on said first and second ends of said wristband, and along the edges of said first and second sides of said wristband.

15. The form of claim 14 wherein said second surface of said second portion of said face ply includes a pressure sensitive adhesive.

16. The form of claim 12 wherein said second surface of said first portion of said face ply includes said pressure sensitive adhesive around the periphery of said wristband, and on said first and second ends of said wristband.

17. The form of claim 16 wherein said second surface of said second portion of said face ply includes a pressure sensitive adhesive.

18. The form of claim 1 in which said form comprises a continuous web of forms defined by lines of weakness.

19. The form of claim 18 wherein said web is folded zig-zag into a stack.

* * * * *